US012092098B2

(12) United States Patent
Benistand-Hector et al.

(10) Patent No.: US 12,092,098 B2
(45) Date of Patent: Sep. 17, 2024

(54) COMPRESSION APPARATUS AND FILLING STATION COMPRISING SUCH AN APPARATUS

(71) Applicant: L'Air Liquide, Societe Anonyme pour l'Etude et l'Exploitation des Procedes Georges Claude, Paris (FR)

(72) Inventors: Cyril Benistand-Hector, Sassenage (FR); Guillaume Petitpas, Sassenage (FR)

(73) Assignee: L'Air Liquide, Societe Anonyme Pour l'Etude et l'Exploitation des Procedes, Georges Claude Paris (FR)

( * ) Notice: Subject to any disclaimer, the term of this patent is extended or adjusted under 35 U.S.C. 154(b) by 88 days.

(21) Appl. No.: 17/800,986

(22) PCT Filed: Oct. 21, 2020

(86) PCT No.: PCT/EP2020/079581
§ 371 (c)(1),
(2) Date: Aug. 19, 2022

(87) PCT Pub. No.: WO2021/164899
PCT Pub. Date: Aug. 26, 2021

(65) Prior Publication Data

US 2023/0071844 A1 Mar. 9, 2023

(30) Foreign Application Priority Data

Feb. 21, 2020 (FR) ..... 2001724

(51) Int. Cl.
*F04B 5/02* (2006.01)
*F04B 3/00* (2006.01)
(Continued)

(52) U.S. Cl.
CPC ..... *F04B 5/02* (2013.01); *F04B 3/003* (2013.01); *F04B 7/04* (2013.01); *F04B 15/08* (2013.01);
(Continued)

(58) Field of Classification Search
CPC .... F04B 5/02; F04B 3/003; F04B 7/04; F04B 15/08; F04B 23/021; F04B 53/12; F04B 2015/081
(Continued)

(56) References Cited

U.S. PATENT DOCUMENTS 817,538 A * 4/1906 Wixon ..... F04B 3/003 417/258
1,166,098 A * 12/1915 Watson ..... F04B 3/003 417/400
(Continued)

FOREIGN PATENT DOCUMENTS

FR 2 406 736 5/1979

OTHER PUBLICATIONS

International Search Report and Written Report for PCT/EP2020/079581, mailed Nov. 11, 2020.
French Search Report for FR 2 001 724, mailed May 6, 2020.

*Primary Examiner* — Bryan M Lettman
(74) *Attorney, Agent, or Firm* — Elwood L. Haynes

(57) ABSTRACT

The invention relates to a fluid compression apparatus comprising a first and a second compression chamber, an intake system communicating with the first compression chamber, a transfer system communicating with the first and second compression chambers, and a mobile piston for ensuring the compression of the fluid in the first and second compression chambers. The apparatus further comprises a discharge port which communicates with the second compression chamber and is configured to allow the outlet of
(Continued)

compressed fluid, wherein the second compression chamber is defined by a part of the body of the piston and a fixed wall of the apparatus, the piston being translationally mobile according to a longitudinal direction, the piston having a tubular portion mounted around a fixed central guide, a terminal end of the central guide forming the fixed wall defining a part of the second compression chamber. The apparatus further comprises a sealing system formed between the central guide and the piston according to the longitudinal direction of translation of the piston, the intake system being located at a first end of the apparatus, the discharge port being located at a second end of the apparatus and the transfer system being located between the intake system and the discharge port.

15 Claims, 9 Drawing Sheets

(51) Int. Cl.
*F04B 7/04* (2006.01)
*F04B 15/08* (2006.01)
*F04B 23/02* (2006.01)
*F04B 53/12* (2006.01)

(52) U.S. Cl.
CPC ..... *F04B 23/021* (2013.01); *F04B 53/12* (2013.01); *F04B 2015/081* (2013.01)

(58) Field of Classification Search
USPC ..... 417/901
See application file for complete search history.

(56) References Cited

U.S. PATENT DOCUMENTS

| | | | | | |
|---|---|---|---|---|---|
| 2,054,710 | A * | 9/1936 | Okada | F04B 23/023 | 417/493 |
| 2,284,505 | A * | 5/1942 | Zehner | F04B 53/128 | 417/448 |
| 2,880,927 | A | 4/1959 | Ploegert | | |
| 3,136,136 | A | 6/1964 | Gottzmann | | |
| 3,254,607 | A * | 6/1966 | Norton | F04B 53/162 | 417/511 |
| 3,263,622 | A * | 8/1966 | Tyree, Jr. | F04B 19/022 | 417/513 |
| 4,239,460 | A * | 12/1980 | Golz | F04B 3/003 | 417/259 |
| 4,369,633 | A | 1/1983 | Snyder | | |
| 5,511,955 | A | 4/1996 | Brown et al. | | |
| 5,885,061 | A * | 3/1999 | Olofsson | F04B 5/02 | 417/258 |
| 6,006,525 | A * | 12/1999 | Tyree, Jr. | F02M 21/0245 | 62/50.7 |
| 7,410,348 | B2 | 8/2008 | Chalk et al. | | |
| 2015/0233362 | A1* | 8/2015 | Jiang | F04B 25/04 | 417/254 |
| 2019/0145392 | A1* | 5/2019 | Brown | F04B 23/021 | 417/379 |

* cited by examiner

[FIG.1]
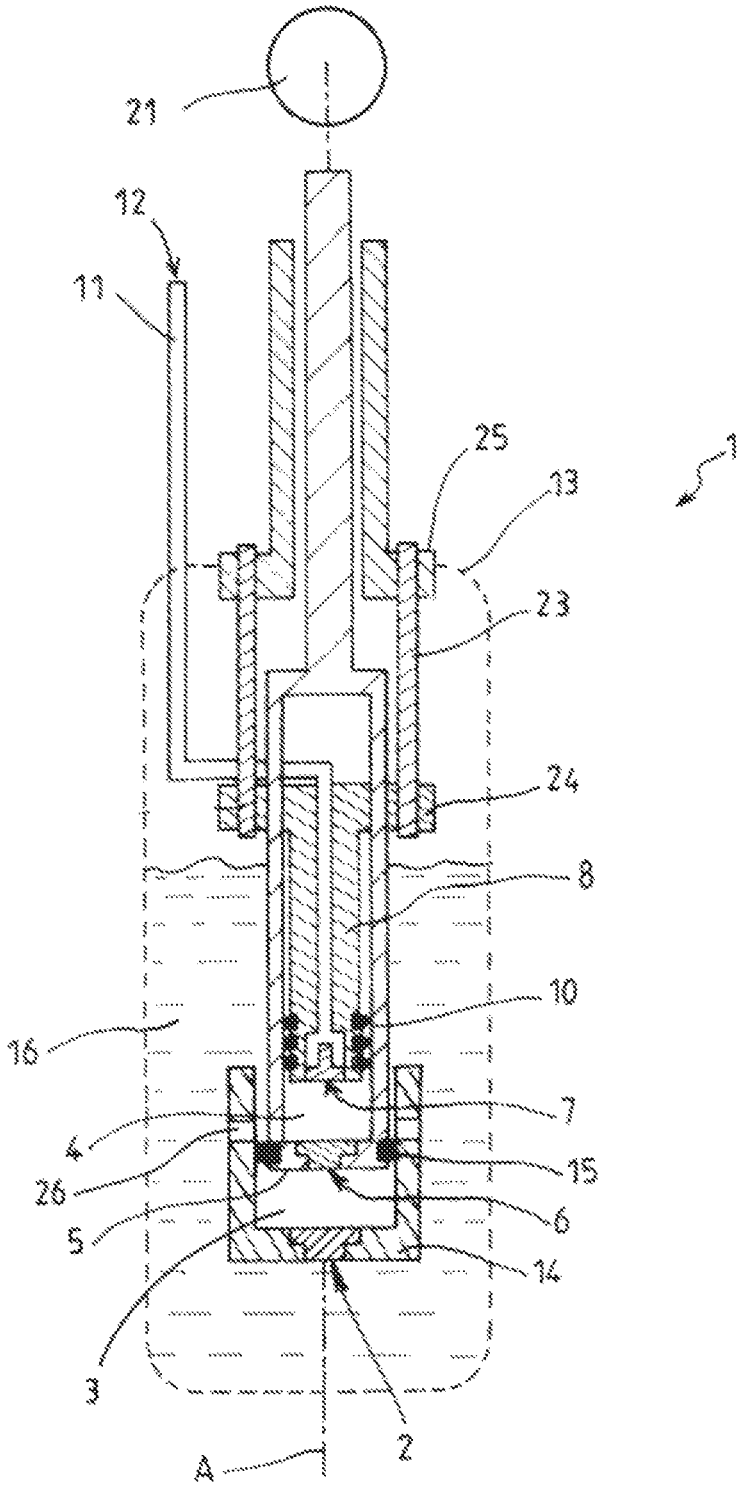

[FIG.2]
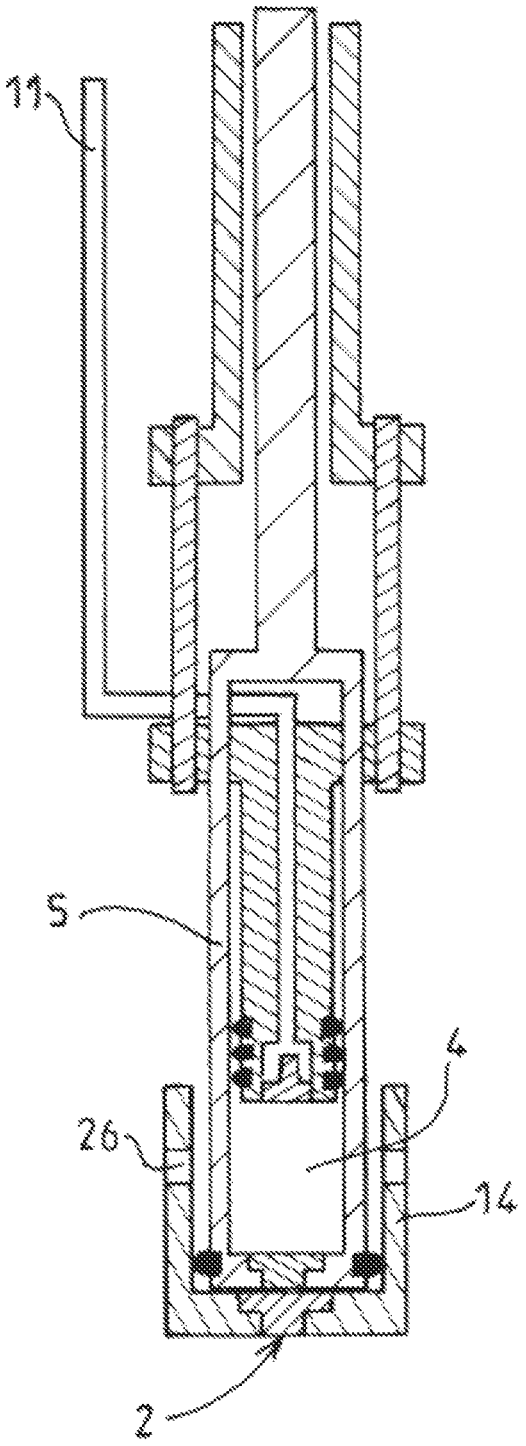

[FIG.3]
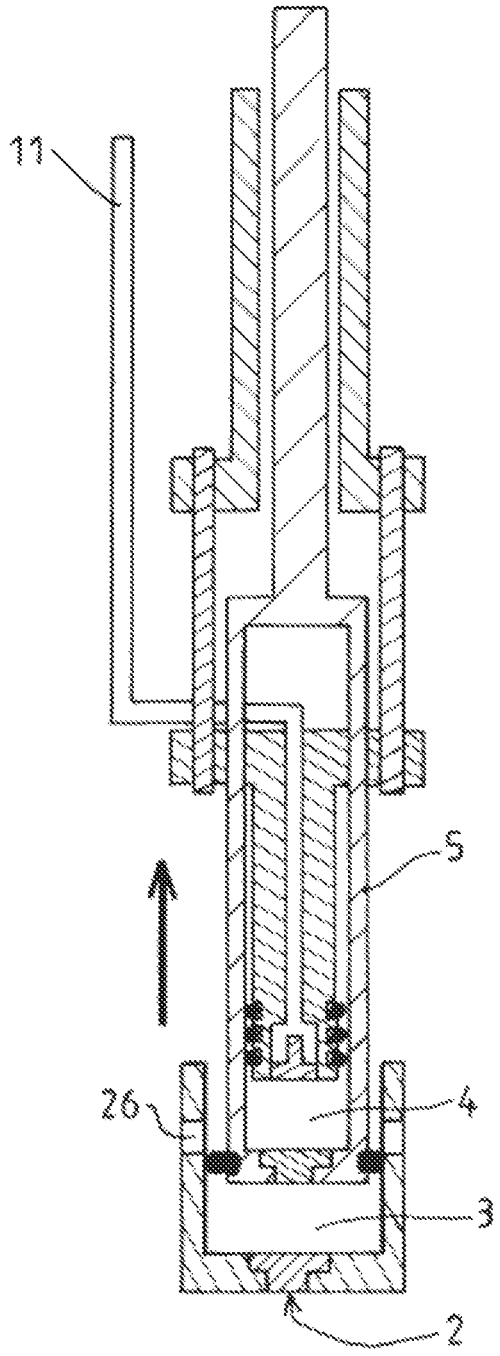

[FIG.4]
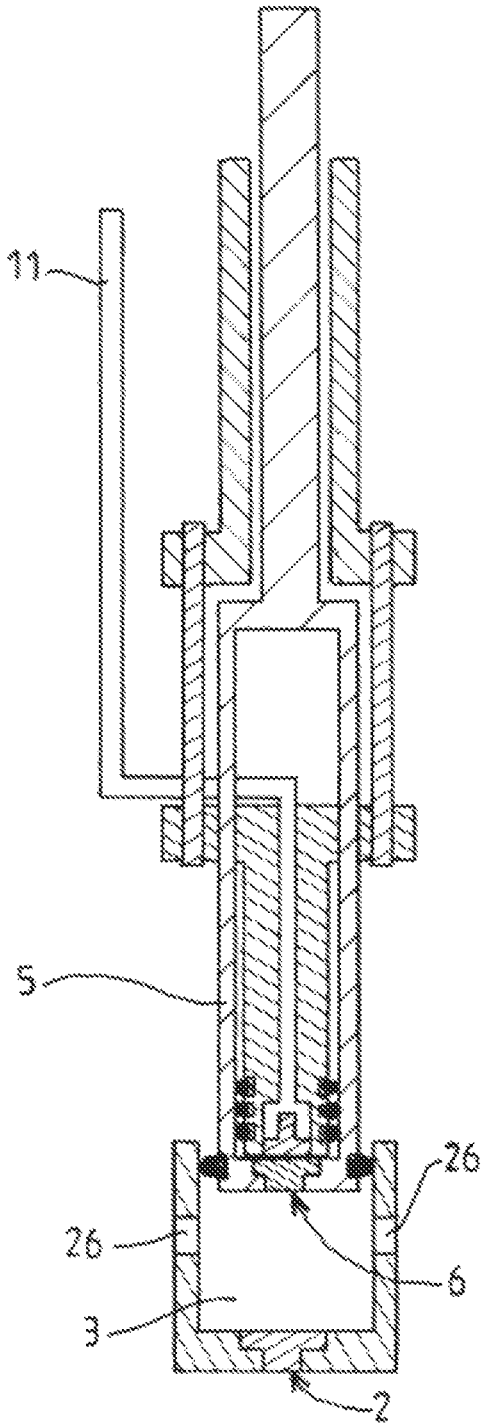

[FIG.5]
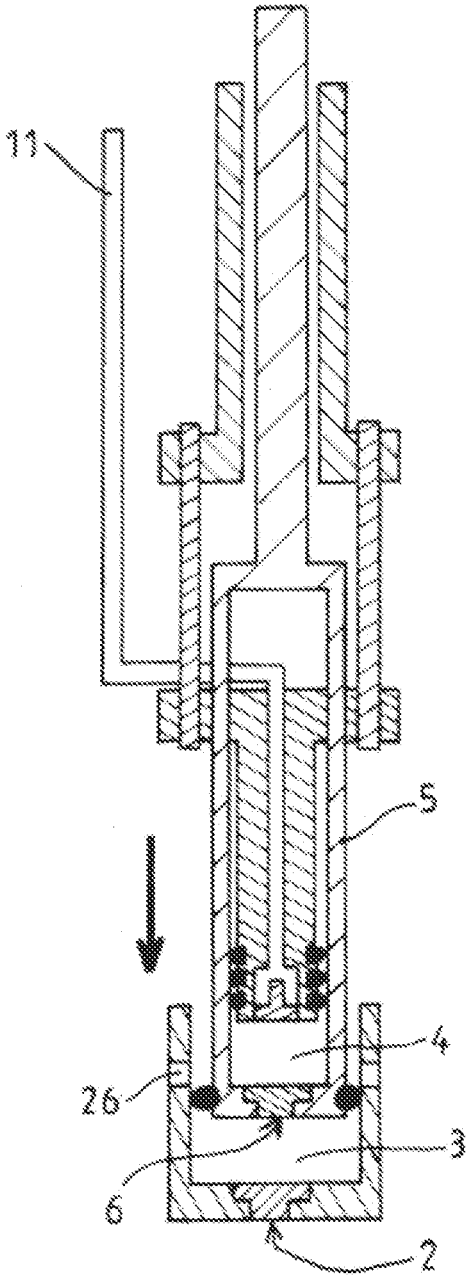

[FIG.6]
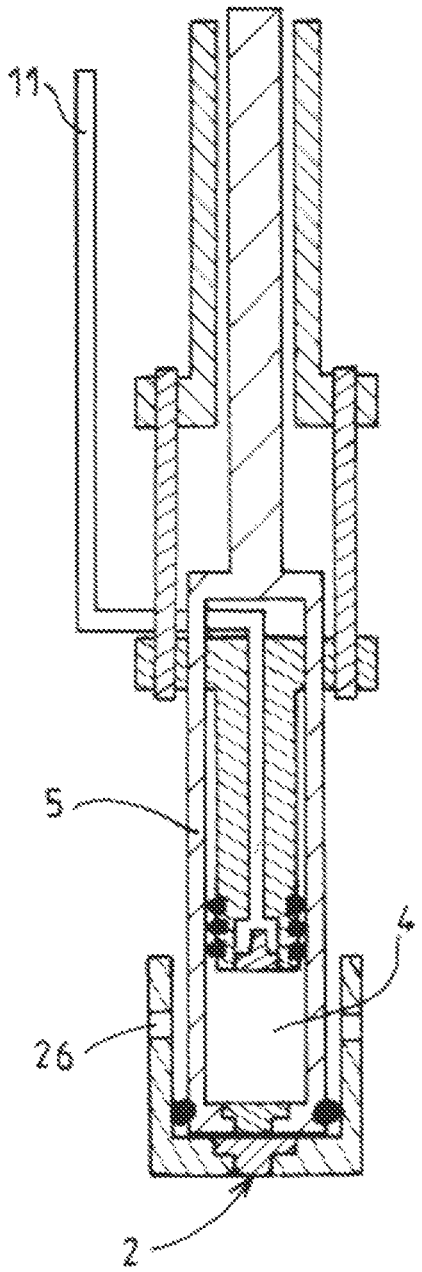

[FIG.7]
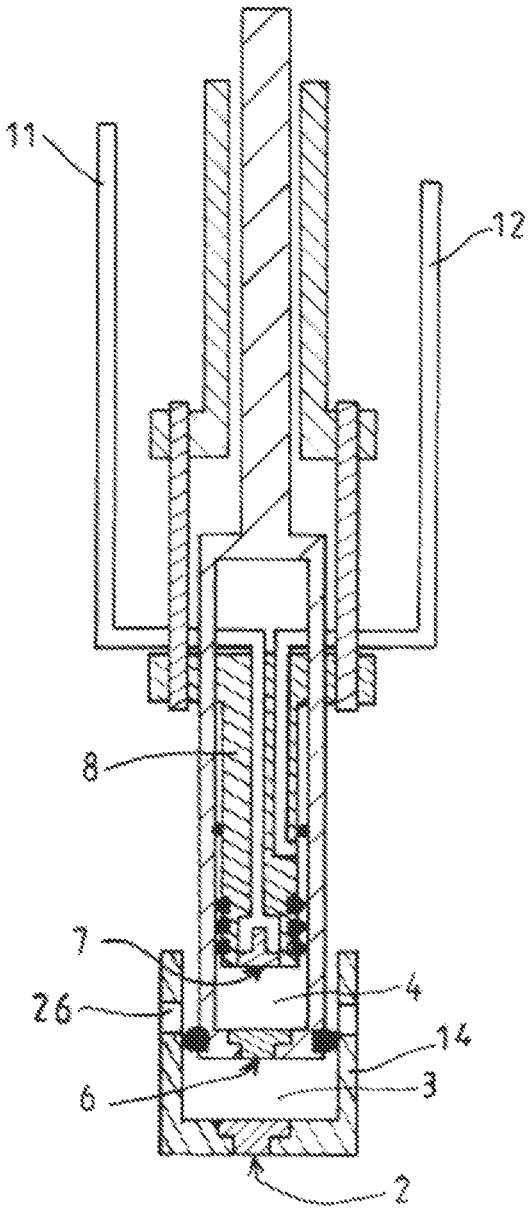

[FIG.8]
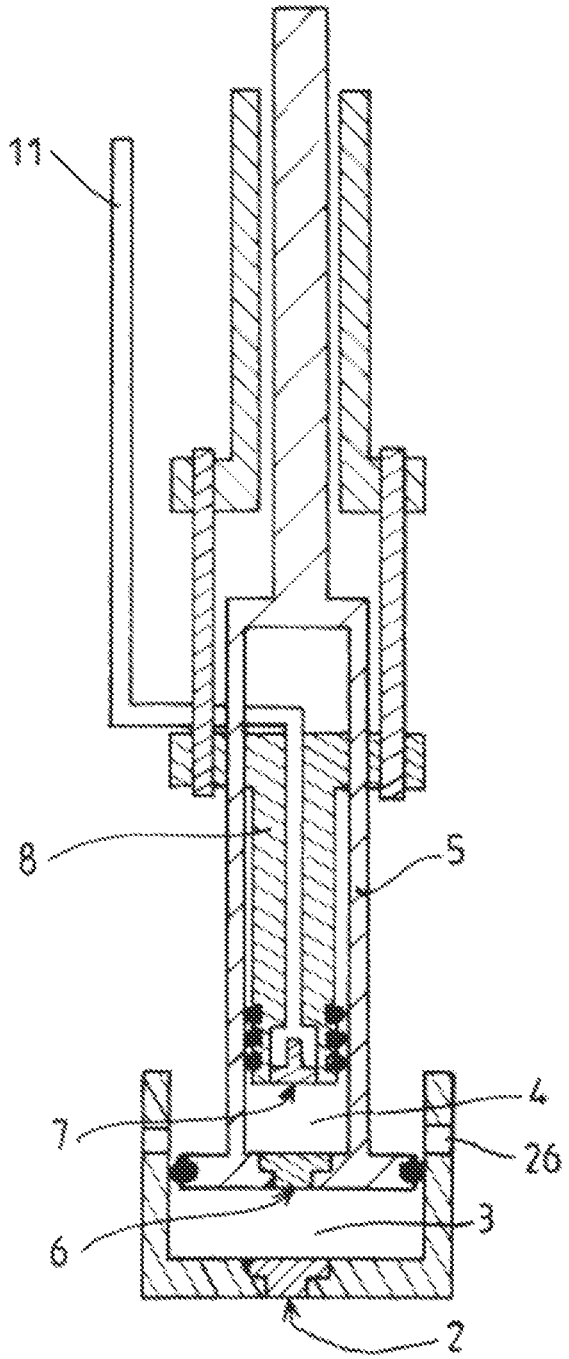

[FIG.9]
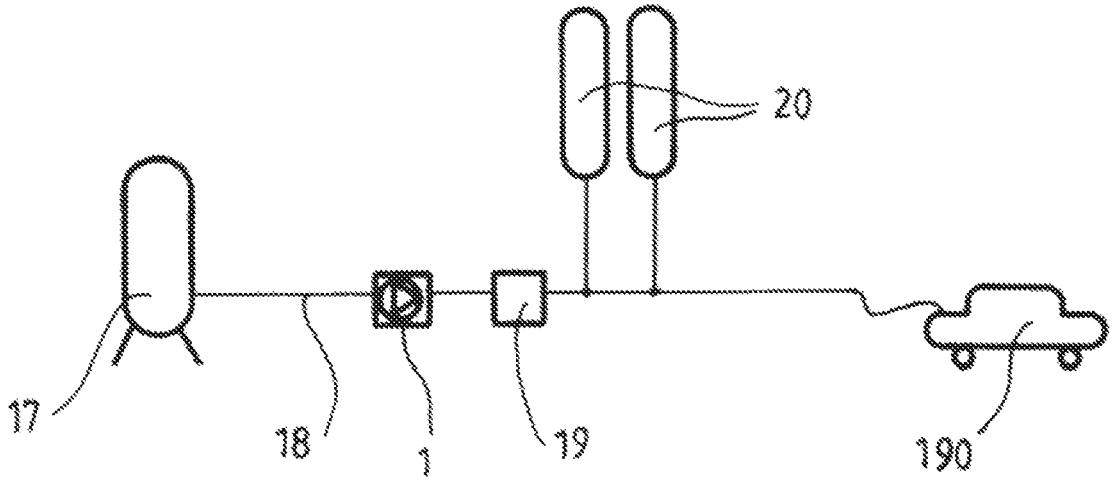

COMPRESSION APPARATUS AND FILLING STATION COMPRISING SUCH AN APPARATUS

CROSS-REFERENCE TO RELATED APPLICATIONS

This application is a § 371 of International PCT Application PCT/EP2020/079581, filed Oct. 21, 2020, which claims § 119(a) foreign priority to French patent application FR 2001724, filed Feb. 21, 2020.

BACKGROUND

Field of the Invention

The invention relates to a cryogenic fluid compression apparatus, and to a filling station comprising such an apparatus.

The invention relates more particularly to a fluid compression apparatus with multiple compression stages, comprising a first compression chamber, a second compression chamber, an intake system that communicates with the first compression chamber and is configured to allow the admission of fluid to be compressed into said first is compression chamber, a transfer system that communicates with the first and the second compression chamber and is configured to allow the transfer of fluid from the first compression chamber to the second compression chamber, a mobile piston for ensuring the compression of the fluid in the first and second compression chambers, the apparatus also comprising a discharge orifice that communicates with the second compression chamber and is configured to allow compressed fluid to leave, the second compression chamber being delimited by a portion of the body of the piston and a fixed wall of the apparatus, the piston being mobile in a translational movement in a longitudinal direction.

The invention relates in particular to an apparatus for compressing or pumping cryogenic gases and/or liquids.

Related Art

In the following text, in particular the terms "compression apparatus" and "pump" may be used interchangeably, as may the terms "pumping" and "compression". Specifically, the apparatus that is the subject of the invention is an apparatus for pumping and/or compressing liquid and/or gaseous and/or supercritical cryogenic fluid.

Cryogenic fluids have densities that are much higher than gaseous fluids. Consequently, cryogenic pumps (as opposed to gas compressors) offer higher mass flow rates, a smaller volume, consume less energy and require less maintenance. It is for this reason that cryogenic pumps are used in numerous fields such as units for separating gases from air, reformers, filling stations, maritime sectors.

The fluids in question generally comprise oxygen, nitrogen, natural gas, argon, helium or hydrogen. These compression apparatuses (or pumps) have the function of pressurizing a cryogenic fluid to a target flow rate.

For example, a cryogenic piston pump may be placed directly in line at the outlet of the cryogenic source store or in a dedicated cryogenic bath (also known as a "sump") situated alongside and fed directly by a main storage tank.

For various reasons, in particular the convenience of maintenance and design, the cryogenic pump generally exhibits a reciprocating movement and is inserted into a tank so as to be submerged in the cryogenic fluid to be pumped.

Cryogenic pumps generally have inlet pressures of between 1 and 12 bar and outlet pressures of 20 to 1000 bar, depending on the application. The pumps may have one or more compression stages using a back-and-forth movement.

A mechanism having two compression stages is often preferred because it allows the intake phase (during which the fluid needs to be as dense and therefore also as cold as possible) to be disconnected from the pressurizing phase (in which quantities of heat detrimental to the method may be generated). The key performance indicators for cryogenic piston pumps are: the volumetric efficiency, the evaporation losses, the energy consumption, the footprint and the durability.

The key features of reciprocating cryogenic pumps should therefore be:

- an intake density that is high as possible,
- very good thermal insulation with respect to the environment,
- minimum dead volume (and therefore a high compression ratio),
- a simple and robust setup for rapid maintenance and high reliability,
- good control of evaporation losses in order to limit the impact thereof.

Document U.S. Pat. No. 7,410,348 describes a horizontal piston pump with two compression stages and axial intake via a nonretum valve and radial discharge. This setup exhibits a substantial dead volume. In addition, the leakage losses are relatively high at the two systems of high-pressure seals situated one on either side of the high-pressure chamber.

This also leads to a more difficult setup and more difficult maintenance.

SUMMARY OF THE INVENTION

An aim of the present invention is to overcome all or some of the drawbacks of the prior art that are set out above.

To this end, the compression apparatus according to the invention, in other respects in accordance with the generic definition thereof given in the above preamble, is essentially characterized in that the piston comprises a tubular portion mounted around a fixed central guide, a terminal end of the central guide forming the fixed wall is delimiting part of the second compression chamber, the apparatus comprising a sealing system formed between the central guide and the piston, and, in the longitudinal direction of translation of the piston, the intake system being situated at a first end of the apparatus, the discharge orifice being situated at a second end of the apparatus and the transfer system is situated between the intake system and the discharge orifice.

Furthermore, embodiments of the invention may have one or more of the following features:

- one end of the piston forms a mobile surface for compressing the fluid in the first compression chamber whereas the tubular portion of the piston forms a mobile sleeve which collaborates with the terminal end of the central guide to form a system for compressing the fluid in the second compression chamber, in which compression system the terminal end of the central guide forms a fixed piston,
- in the operating configuration, the longitudinal direction of translation of the piston is vertical or inclined, the intake system being situated at a lower end of the apparatus, the discharge orifice being situated in a part of the apparatus that is situated above the intake system and preferably above the transfer system, the entirety of the second compression chamber is contained in the tubular portion of the piston, in the longitudinal direction, a first end of the second compression chamber is delimited by a first end of the tubular piston, and a second end of the second compression chamber is delimited by the terminal end of the central guide and the sealing system formed between the central guide and the piston, said sealing system being situated level with or adjacent to the terminal end of the central guide, the sealing system formed between the central guide and the piston is situated only at the level of the second end of the second compression chamber and/or beyond the second compression chamber in the opposite direction to the first end of the apparatus in the longitudinal direction, the discharge orifice is situated at the level of the terminal end of the central guide, the apparatus comprising a duct for discharging the compressed gas and comprising a first end connected to the discharge orifice and a second end situated at the opposite end to the first end of the apparatus, the first compression chamber is delimited by a first fixed cavity, one end of the piston and a sealing system formed between the piston and a wall of the first cavity, the intake system is situated at an end of the first cavity opposite to the second end of the apparatus, the intake system comprises at least one of the following: one or more nonretum valves, one or more orifices or port(s), at least one flat-disc valve or valves configured to allow the admission of fluid that is to be compressed into the first compression chamber during an intake phase and to prevent fluid from leaving in the compression phase, a fixed wall portion delimiting the first compression chamber comprises one or more ports or orifices preferably arranged in the longitudinal direction so that they either do or do not allow communication between the first compression chamber and the outside, depending on the longitudinal position of the piston, the compression of the fluid in the second compression chamber is brought about by a stroke of the piston in the direction of the second end of the apparatus, the apparatus is housed in a sealed enclosure containing a bath of cryogenic cooling fluid the apparatus comprises a leakage gas discharge circuit comprising a first end communicating with the space between the piston and the central guide and a second end opening at the level of the second end of the apparatus.

The invention also relates to a station for filling tanks of pressurized gas comprising a source of liquefied gas, in particular liquefied hydrogen, a withdrawal circuit having a first end connected to the source and at least one second end intended to be connected to a tank that is to be filled, the withdrawal circuit comprising a fluid pumping apparatus or a fluid compression apparatus according to any one of the features above or below.

The invention may also relate to any alternative device or method comprising any combination of the features above or below within the scope of the claims.

BRIEF DESCRIPTION OF THE FIGURES

Other specific features and advantages will become apparent from reading the following description, which is given with reference to the figures, in which:

FIG. 1 shows a schematic and partial view in longitudinal and vertical section illustrating the structure of one exemplary embodiment of a compression apparatus according to the invention, FIG. 2 shows a schematic and partial view in longitudinal and vertical section illustrating a first configuration of an operating cycle of the compression apparatus according to the invention, FIG. 3 shows a schematic and partial view in longitudinal and vertical section illustrating a second configuration of an operating cycle of the compression apparatus according to the invention, FIG. 4 shows a schematic and partial view in longitudinal and vertical section illustrating a third configuration of an operating cycle of the compression apparatus according to the invention, FIG. 5 shows a schematic and partial view in longitudinal and vertical section illustrating a fourth configuration of an operating cycle of the compression apparatus according to the invention, FIG. 6 shows a schematic and partial view in longitudinal and vertical section illustrating a fifth configuration of an operating cycle of the compression apparatus according to the invention, FIG. 7 shows a schematic and partial view in longitudinal and vertical section illustrating the structure of another exemplary embodiment of a compression apparatus according to the invention, FIG. 8 shows a schematic and partial view in longitudinal and vertical section illustrating the structure of yet another exemplary embodiment of a compression apparatus according to the invention, FIG. 9 shows a schematic and partial view illustrating an example of a filling station using such a compression apparatus.

DETAILED DESCRIPTION OF THE INVENTION

The fluid compression apparatus 1 depicted in [FIG. 1] comprises two compression stages in series.

The apparatus 1 in particular comprises a first compression chamber 3 (at relatively low pressure) and a second compression chamber 4 (at relatively high pressure).

The apparatus 1 comprises an intake system 2 communicating with the first compression chamber 3 which is configured to allow fluid that is to be compressed to be admitted into said first compression chamber 3. The intake system 2 may comprise for example at least one of: one or more nonretum valves, one or more orifices or port(s), at least one flat-disc valve or any other device or valve that allows fluid that is to be compressed to be admitted into the first compression chamber 3 during an intake phase and prevents fluid from leaving in the compression phase. In particular, this intake system 2 (valve shutter(s) and/or the like) opens in the case of a given pressure difference between its two ends. In addition, the first chamber 3 may possibly be equipped with a relief valve or some other safety element configured to limit the pressure within the chamber to below a given safety threshold.

The apparatus 1 also comprises a nonretum transfer system 6 that communicates with the first 3 and the second 4 compression chamber and is configured to allow the transfer of fluid from the first compression chamber 3 to the second compression chamber 4 (during and/or at the end of the phase of compression of fluid in the first compression chamber 3) but which remains closed during the phase of compression in the second compression chamber 4. This transfer system 6 may be of the same type as that of the intake system 2.

The apparatus 1 comprises a mobile piston 5 capable of translational movement for compressing the fluid in the first 3 and second 4 compression chambers (as detailed hereinafter).

The apparatus 1 also comprises a discharge orifice 7 that communicates with the second compression chamber 4 and is configured to allow fluid compressed in the second compression chamber 4 to leave (during or at the end of the phase of compression in this chamber). The discharge orifice 7 may be provided with a nonretum system, which may be of the same type as that of the intake system 2 (for example closed as long as the pressure difference between the second compression chamber 4 and the outside is below a given threshold).

The second compression chamber 4 is delimited by a portion of the body of the piston 5 and a fixed wall of the apparatus. The piston 5 is able to move in translation in a longitudinal direction A.

As illustrated, the piston 5 comprises a tubular portion mounted around a fixed central guide 8. A terminal end of the central guide 8 forms a fixed wall delimiting a part of the second compression chamber 4. The apparatus 1 comprises a sealing system 10 formed between the central guide 8 and the piston 5 (piston ring(s), seal(s) or the like).

In the longitudinal direction A of translation of the piston 5, the intake system 2 is situated at a first end of the apparatus 1, the discharge orifice 7 being situated at a second end of the apparatus, and the transfer system 6 is situated between the intake system 2 and the discharge orifice 7. That means to say that the orifices 2, 6 and 7 for the passage of the fluid are positioned in series in that order which corresponds to an increasing temperature of the fluid in the compression apparatus 1 (cold on being admitted into the first compression chamber 3, then hot in the second compression chamber 4 and hotter still on leaving this second compression chamber 4).

As illustrated, one end of the piston 5 forms a mobile surface for compressing the fluid in the first compression chamber 3 whereas the tubular portion of the piston 5 forms a mobile sleeve which collaborates with the terminal end of the central guide 8 to form a system for compressing the fluid in the second compression chamber 4 (in this second compression stage, the terminal end of the central guide 8 thus forms a fixed piston collaborating with a mobile sleeve).

As illustrated, in the operating configuration, the longitudinal direction A of translation of the piston (5) is preferably vertical or inclined so that the intake system 2 is situated at a lower end of the apparatus 1, the discharge orifice 7 being situated in a part of the apparatus that is situated above the intake system 2 and preferably above the transfer system 6.

This preferred embodiment will be described in greater detail hereinafter. However, of course, as an alternative, the longitudinal axis A could be horizontal in the operating configuration or could be inclined in order to reverse the relative vertical positions described above.

Thus, when the longitudinal direction A of translational movement of the piston 5 is vertical, the intake system 2 may be situated at a lower end of the apparatus 1. The discharge orifice 7 is itself situated in an upper part of the apparatus 1, namely above the intake system 2.

This configuration ensures that fluid that is to be compressed is admitted into the lower part, which is to say into the coldest region of the apparatus 1. In addition, the delivery and any leaks are located in the upper region of the apparatus (which is hotter). This configuration encourages minimal or zero mixing between the two, relatively cold and hot, regions. In addition, the hot fluids are offset into the upper part which may contain the piston actuating mechanism 21 and which generates heat.

This vertical arrangement with a vertical compression stroke allows good separation between the streams of a relatively cold fluid (at the intake) and relatively hot fluid (at the exhaust). In particular, the compression stroke in the second compression chamber 4 is an upstroke (the rod of the piston 5 being pulled upward and toward the hot part of the apparatus 1).

In particular, this upstroke of the piston 5 during the compression to a high pressure generates a tensile force on the rod of the piston 5. This is favorable from a mechanical standpoint This is because under this tensile force, the rod is not subjected to buckling (which it would be under compression/thrust). In addition, this tensile compression arrangement does not require the piston rod to be guided regularly along its length.

This also allows the cross-sectional area of the piston rod to be reduced (for example by making the rod hollow or reducing the diameter thereof). In addition, it makes it possible to reduce the length of the piston rod according to the acceptable level of thermal losses.

Schematically depicted, the piston 5 can be driven by a motor member 21 or drive mechanism connected to a motor member situated in the upper part or offset.

As illustrated, the first compression chamber 3 may be formed in a tubular cavity 14 or fixed chamber which is closed at its lower end. The first compression chamber 3 may thus be delimited in the lower part by this fixed lower cavity 14. The intake system 2 may be situated at a lower end of the lower cavity 14.

The first compression chamber 3 may thus be delimited in the upper part by a lower end of the piston 5 and a sealing system 15 (piston rings or the like) formed between the piston 5 and a wall of the lower cavity 14.

As a preference, the lower part of the piston 5 has a profile configured to encourage the gas to escape via the ports or valves. For example, as schematically indicated notably in [FIG. 4], one or more ports 26 (or orifices) may be formed in the upper part of the lower cavity 14 (or any fixed wall portion delimiting at least part of the first compression chamber). These ports 26, when the piston 5 uncovers them (when the piston 5 is above at least part of the ports 26), allow communication between the first compression chamber 3 and the outside. Thus, in the intake phase (as the chamber 3 is enlarging), any gas that might be present in the first compression chamber 3 can escape via these ports 26 and give up its place to liquid from the surrounding bath. This ensures complete filling with liquid during admission. In addition, in the compression phase (the piston 5 moving down in the second compression chamber 3), these ports 26 allow the surplus liquid to escape, thereby metering the volume of liquid to be trapped therein (this volume can be determined by the longitudinal position of the ports 26). The piston 5 then continues its compression stroke in the first compression chamber 3 and the ports 26 no longer communicate with the compressed volume (which is isolated from the bath 16).

It should be noted that these ports 26 or orifices may form part of or may even constitute the intake system admitting fluid into the first compression chamber 3. What that means to say is that the aforementioned intake valve(s) system 2 situated at a lower end of the lower cavity 14 could potentially be omitted and the admission of fluid into the first compression chamber 3 could in such an instance be assured by the aforementioned ports 26 or orifices alone.

Thus, the tubular portion of the piston 5 forms an enclosure surrounding the entire second compression chamber 4. Thus, the second compression chamber 4 may be contained entirely in the tubular portion of the piston 5. Thus, the piston 5 may constitute the casing of the second compression chamber 4. This architecture makes it possible to confine the second compression chamber 4 entirely inside the piston 5, the walls of which may be thermalized (that is to say kept cold) effectively, as described below.

The lower end of the second compression chamber 4 may thus be delimited by a lower end of the tubular piston 5 and the upper end of the second compression chamber 4 may be delimited by the terminal lower end of the central guide 8 and the sealing system 10 formed between the central guide 8 and the piston 5.

It should be noted that this sealing system 10 is situated at or above the lower end of the central guide 8, above the upper end of the second compression chamber 4.

This architecture thus makes it possible to provide a single high-pressure dynamic sealing system at just one end of the second compression chamber 4. Thus, the sealing system 10 formed between the central guide 8 and the piston 5 can be situated only at the upper end of the second compression chamber 4 and/or above the second chamber 4.

By contrast, in the prior art mentioned hereinabove, two high-pressure dynamic sealing systems were provided, one on each side of the high-pressure compression chamber (one on each side with reference to the direction of the stroke of the piston).

In comparison with the prior art, this arrangement greatly reduces manufacturing and maintenance constraints and the risk of leaks.

The transfer system 6 is situated for example on the lower end of the tubular wall of the piston 5 one of the faces of which delimits the upper end of the first compression chamber 3. As previously, this transfer system 6 may be a single or multiple system and may have any structure suitable for allowing the transfer of fluid from the first chamber 3 to the second chamber 4 (during the compression phase in the first compression chamber 3 but preventing the transfer of fluid from the second chamber 4 to the first chamber during compression in the second chamber 4).

The discharge orifice 7 may be situated at the lower end of the central guide 8 (the fixed upper end of the second compression chamber 4). The apparatus 1 may comprise a compressed gas discharge duct 11 comprising a lower first end connected to this discharge orifice 7 and an upper second end situated in the upper part of the apparatus 1 collecting the compressed high-pressure fluid.

As illustrated in [FIG. 1], the compression apparatus may be housed in a thermally insulated sealed enclosure 13 containing a bath 16 of cryogenic cooling fluid. In particular, the first 3 and second 4 compression chambers may be submerged in a liquid phase. The upper part of the enclosure 16 may have a gas headspace which collects any leaks in the apparatus 1.

Thus, the cold head of the apparatus 1 may be submerged vertically in a cryogenic bath 16 (sometimes referred to as a sump).

The first compression chamber 3 could be fixed directly to the bottom of the bath 16.

The moving part (the piston 5) has a vertical (up and down) movement. Mounting plates 24, 25 and shafts 22, 23 may be provided outside of the compression chambers 3, 4 for mounting purposes and for allowing the compression movements with respect to the fixed parts.

Naturally, the structure of the piston 5 is designed so as, in this case, to allow a part (in this case the rear part) of the piston 5 to slide in the plate 24 (or similar). For example, the lower portion of the piston 5 is tubular (and forms the second compression chamber 4) while the opposite (upper) part of the piston 5 is designed to allow the sliding with respect to the plate 24.

For example, the upper part of the piston 5 has one or more openings for the passage of the plate 24. The piston 5 can be made in one or more pieces that are joined/secured together.

One example of a compression cycle will now be described in connection with [FIG. 2] to [FIG. 6].

In [FIG. 2], the piston 5 is in the extreme lower position (first compression chamber 3 empty and fluid at a pressure of, for example, between 2 and 20 bar in the second compression chamber 4). Cold fluid at low pressure (for example from 1 to 10 bar) situated in the bottom of the enclosure 13 may be admitted into the first compression chamber 3 by the intake system 2 as the piston 5 ascends (and the fluid is pressurized in the second compression chamber 4).

As the piston gradually ascends ([FIG. 3]), more fluid fills the first compression chamber 3. The fluid in the second compression chamber 4 is compressed. The first compression chamber 3 is filled. When the pressure in the second compression chamber 4 becomes greater than the determined pressure downstream (for example 100 to 1000 bar, depending on the application), the discharge system 7 opens, emptying the high-pressure fluids upward via the discharge duct 11.

In the extreme upper position ([FIG. 4]), the second compression chamber 4 is emptied and the first compression chamber 3 is full.

After the top dead position ([FIG. 5]), during the downstroke of the piston 5, because the pressure in the second chamber 4 from the preceding cycle drops below the pressure in the first compression chamber 3, the fluid moves from the first compression chamber 3 to the second compression chamber 4 via the transfer system 6 ([FIG. 5]). The port or ports 26 communicate with the first compression chamber 3 until such point as the piston 5 passes through a determined bottom longitudinal position. When the pressure equalizes after the bottom dead position, the second compression chamber 4 is isolated.

The apparatus returns to the starting configuration and can recommence a cycle ([FIG. 6]).

This architecture with a compression stroke and separation of the cold (at the bottom) and hot (at the top) parts allows the compression to work better. The relatively long distance between the intake (preferably at the bottom) and the discharge (preferably at the top) promotes this advantage.

This is because fluid is admitted at the level where the fluid is at its coldest and most dense whereas the hotter fluids are offset upward. This minimizes the risks of mixing and of ebullition in the bath 16. The hot fluids (leaks) can be collected directly in the upper part without the need for dedicated pipework.

The whole can be housed in a casing.

FIG. 7 illustrates a variant in which an optional leakage-gas discharge circuit 12 is provided. For example, the circuit 12 comprises a duct having a first end communicating with the space between the piston 5 and the central guide 8 (above the sealing system 10 and possibly below an additional upper seal that might be present) and a second end opening to the upper part of the apparatus 1.

In the variant of [FIG. 8], the geometry of the lower end of the piston 5 can be adapted to modify the ratio of the volumes of the two compression chambers 3, 4, for example to increase the size of the first compression chamber 3 with respect to the second compression chamber 4.

A compression apparatus 1 of this type (or a plurality in series or in parallel) may be used in any cryogenic installation that requires the pumping or compressing of a cryogenic fluid.

For example, a station for filling tanks of pressurized gas (hydrogen for example) may comprise a source 17 of liquefied gas, a withdrawal circuit 18 having a first end connected to the source and at least one second end intended to be connected to a tank 190 to be filled, the withdrawal circuit 18 comprising such a pumping apparatus 1. The fluid pumped may be vaporized in a downstream exchanger 19 and optionally stored in one or more pressurized buffer tanks 20.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A fluid compression apparatus with multiple compression stages, comprising: a sealed enclosure and containing a bath of cryogenic fluid comprising a liquid phase, an upper part of the enclosure comprising a gas headspace; a first compression chamber; a second compression chamber; an intake system that communicates with the first compression chamber and is configured to allow the admission of fluid to be compressed into said first compression chamber; a transfer system that communicates with the first and the second compression chamber and is configured to allow the transfer of fluid from the first compression chamber to the second compression chamber; a mobile piston for ensuring the compression of the fluid in the first and second compression chambers; a discharge orifice that communicates with the second compression chamber and is configured to allow compressed fluid to leave through a discharge duct, the second compression chamber being delimited by a portion of a body of the mobile piston and a fixed wall of the apparatus, the mobile piston being mobile in a translational movement in a longitudinal direction; and a sealing system, wherein: the mobile piston comprises a tubular portion mounted around a fixed central guide, a terminal end of the fixed central guide forming the fixed wall delimiting part of the second compression chamber, the sealing system is formed between the fixed central guide and the mobile piston, in the longitudinal direction of translation of the mobile piston, the intake system is situated at a first end of the apparatus, the discharge orifice is situated at a second end of the apparatus, the transfer system is situated between the intake system and the discharge orifice, the first and second compression chambers are immersed in the liquid phase of the bath, and the intake system comprises one or more ports that either do or do not allow communication between the first compression chamber and the bath on the outside, depending on a longitudinal position of the mobile piston, wherein the mobile piston is actuated by a piston actuating mechanism, and wherein the intake system is located at the first end of the apparatus and the discharge duct and the piston actuating mechanism are located at the second end of the apparatus, which is an opposite end in the longitudinal direction.

2. The apparatus of claim 1, wherein the one or more ports are arranged such that, when the mobile piston moves to a position situated beyond at least a part of the one or more ports, the one or more ports allow communication between the first compression chamber and the bath outside.

3. The apparatus of claim 2, wherein, during a compression phase when the mobile piston is reducing a volume of the first compression chamber, the one or more ports are configured to allow surplus liquid to escape and meter a volume of liquid trapped in the first compression chamber to a determined value before ceasing to communicate with the first compression chamber.

4. The apparatus of claim 1, wherein, in an intake phase, when a volume of the first compression chamber is increasing, the one or more ports are configured to allow any gas that might be present in the first compression chamber to escape via the one or more ports to the bath outside and and is replaced liquid.

5. The apparatus of claim 1, wherein one end of the mobile piston forms a mobile surface for compressing the fluid in the first compression chamber, the tubular portion of the mobile piston forms a mobile sleeve which collaborates with the terminal end of the fixed central guide to form a system for compressing the fluid in the second compression chamber, a terminal end of the fixed central guide forms a fixed piston.

6. Apparatus of claim 1, wherein, in an operating configuration, the longitudinal direction of translation of the mobile piston is vertical or inclined, the intake system is situated at a lower end of the apparatus, and the discharge orifice is situated in a part of the apparatus that is situated above the intake system.

7. The apparatus of claim 1, wherein an entirety of the second compression chamber is contained within the tubular portion of the mobile piston.

8. The apparatus of claim 1, wherein: in the longitudinal direction, a first end of the second compression chamber is delimited by a first end of the tubular portion of the mobile piston and a second end of the second compression chamber is delimited by the terminal end of the fixed central guide and the sealing system formed between the fixed central guide and the mobile piston; and said sealing system is situated level with or adjacent to the terminal end of the fixed central guide.

9. The apparatus of claim 1, wherein the sealing system formed between the fixed central guide and the mobile piston is situated only at a level of an end of the second compression chamber and/or beyond the second compression chamber in an opposite direction to the first end of the apparatus in the longitudinal direction.

10. The apparatus of claim 1, wherein: the discharge orifice is situated at a level of the terminal end of the fixed central guide; the apparatus comprises a duct for discharging the compressed gas, a first end connected to the discharge orifice, and a second end situated at the second end of the apparatus, opposite to the first end of the apparatus.

11. The apparatus of claim 1, wherein the first compression chamber is delimited by a first fixed cavity and one end of the mobile piston and a second sealing system formed between the mobile piston and a wall of the first cavity.

12. The apparatus of claim 11, wherein the intake system is situated at an end of the first cavity opposite to the second end of the apparatus.

13. The apparatus of claim 1, wherein the intake system comprises one or more nonretum valves; comprising at least one flat-disc valve configured to admit fluid that is to be compressed into the first compression chamber during an intake phase and to prevent fluid from leaving in a compression phase.

14. The apparatus of claim 1, wherein compression of the fluid in the second compression chamber is brought about by a stroke of the mobile piston in a direction of the second end of the apparatus.

15. A station for filling tanks or pipes with pressurized gas, comprising: a source of liquefied hydrogen; and a withdrawal circuit having a first end connected to the source and at least one second end intended to be connected to a tank to be filled, wherein the withdrawal circuit comprises the fluid compression apparatus of claim 1.

* * * * *